US005188448A

United States Patent [19]

Siriani et al.

[11] Patent Number: 5,188,448

[45] Date of Patent: Feb. 23, 1993

[54] TV, VCR, STEREO, CD NIGHT LIGHT

[76] Inventors: Anita Siriani, P.O. Box 72, Montauk, N.Y. 11954; George Spector, 233 Broadway RM 3815, New York, N.Y. 10007

[21] Appl. No.: 905,671

[22] Filed: Jun. 29, 1992

[51] Int. Cl.[5] ..... F21J 33/00

[52] U.S. Cl. ..... 362/109; 362/85; 362/802

[58] Field of Search ..... 362/23, 85, 109, 157, 362/253, 802

[56] References Cited

U.S. PATENT DOCUMENTS

| | | | |
|---|---|---|---|
| 4,905,127 | 2/1990 | Kaminski | 362/109 |
| 4,949,230 | 8/1990 | Burmeister | 362/109 |
| 5,010,462 | 4/1991 | Mintzer | 362/109 |
| 5,055,977 | 10/1991 | Acquanetta | 362/23 |
| 5,115,383 | 5/1992 | Lee | 362/109 |
| 5,122,937 | 6/1992 | Stoudemire | 362/109 |

*Primary Examiner*—Richard R. Cole

[57] ABSTRACT

An illumination device is provided for a remote control unit having a plurality of keys which consists of a housing sized to receive a portion of the remote control unit inserted therein. A lamp is located on the housing and is positioned to shine a light upon the keys of the remote control unit. A battery is located within the housing and is electrically connected to the lamp for supplying power to the lamp. An on/off switch is located on the housing and is electrically connected between the lamp and the battery. A normally opened push button switch is located within the housing and is electrically connected between the battery and the on/off switch. When the remote control unit is inserted into the housing, it will close the push button switch. The on/off switch can be manually turned on to energize the lamp and shine the light upon the keys of the remote control unit allowing a person to operate the keys in a dark environment.

5 Claims, 1 Drawing Sheet

TV, VCR, STEREO, CD NIGHT LIGHT

BACKGROUND OF THE INVENTION

The instant invention relates generally to self-contained light attachments and more specifically it relates to an illumination device for a remote control unit which provides a mechanism to cast a light upon the keys of the remote control unit in a dark environment.

There are available various conventional self-contained light attachments which do not provide the novel improvements of the invention herein disclosed.

SUMMARY OF THE INVENTION

A primary object of the present invention is to provide an illumination device for a remote control unit that will overcome the shortcomings of the prior art devices.

Another object is to provide an illumination device for a remote control unit that will cast a light upon the keys of the remote control unit, so that a person can operate the keys in a dark environment.

An additional object is to provide an illumination device for a remote control unit that is self-contained, removable and selectively actuated to a conventional remote control unit.

A further object is to provide an illumination device for a remote control unit that is simple and easy to use.

A still further object is to provide an illumination device for a remote control unit that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
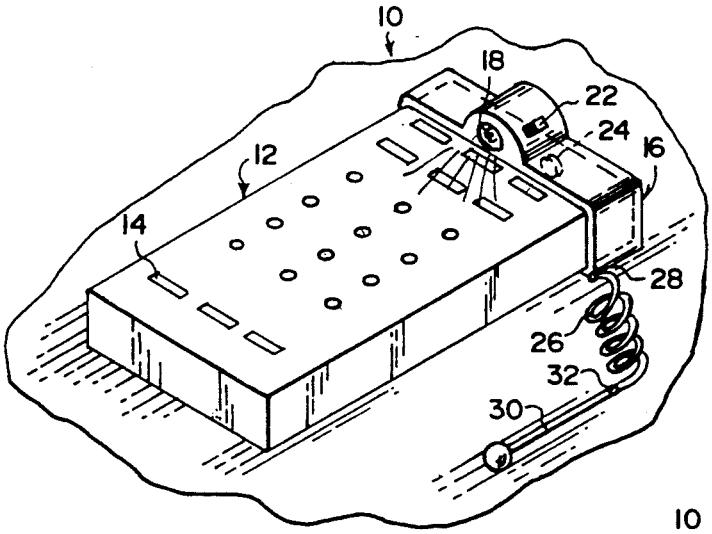
FIG. 1 is a perspective view of a first embodiment of the instant invention as a clip on type.

Turning now descriptively to the drawings, in which similar reference characters denote similar elements throughout the several views, the Figures illustrate an illumination device 10 for a remote control unit 12 having a plurality of keys 14. The device 10 consists of a housing 16 sized to receive a portion of the remote control unit 12 inserted therein. A lamp 18 is located on the housing 16 and is positioned to shine a light upon the keys 14 of the remote control unit 12. A battery 20 is located within the housing 16 and is electrically connected to the lamp 18 for supplying power to the lamp 18. An on/off switch 22 is located on the housing 16 and is electrically connected between the lamp 18 and the battery 20. A normally opened push button switch 24 is located within the housing 16 and is electrically connected between the battery 20 and the on/off switch 22. When the remote control unit 12 is inserted into the housing 16 it will close the push button switch 24. The on/off switch 22 can be manually turned on to energize the lamp 18 and shine the light upon the keys 14 of the remote control unit 12 allowing a person to operate the keys 14 in a dark environment.

The illumination device 10, as shown in FIG. 1, is a clip on type and includes a coiled cord 26 affixed at a first end 28 to the housing 16. A rubber tipped wand 30 is affixed to a second end 32 of the coiled cord 26, so that the rubber tipped wand 30 can be used in depressing the keys 14 of the remote control unit 12.

Figure 2:
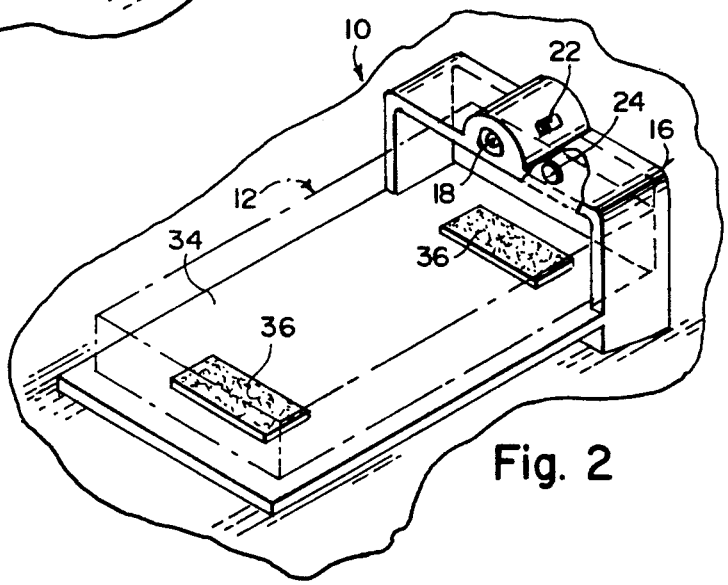
FIG. 2 is a perspective view of a second embodiment of the instant invention as a casement type with parts broken away.
Figure 3:
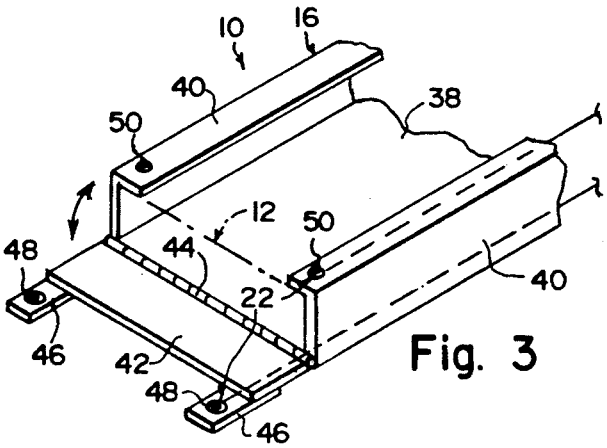
FIG. 3 is a perspective view of a third embodiment of the instant invention with a portion broken away, in which one set of snaps will act as a switch to open the circuit to the push button switch when the back is opened to remove the remote control unit.

The illumination device 10, as shown in FIG. 2, is a casement type and includes an elongated platform 34 extending from a lower portion of the housing 16, and is sized to fit under a lower surface of the remote control unit 12. At least one fastening member 36 is on the elongated platform 34 for retaining the lower surface of the remote control unit 12 to the elongated platform 34.

Figure 4:
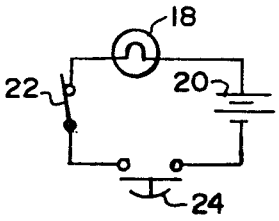
FIG. 4 is a schematic diagram of the electrical circuit.

In the illumination device 10, as shown in FIG. 4, the housing 16 further includes an elongated platform 38 extending from a lower portion of the housing 16. A pair of inverted L-shaped walls 40, each extends upwardly from one side of the elongated platform 38 to receive the remote control unit 12 when inserted therein. A tailgate 42 is hinged at its bottom edge 44 to the rear edge of the elongated platform 38. A flexible strap 46 is mounted to each of two upper corners of the tailgate 42. A female snap member 48 is affixed to each distal end of each flexible strap 46. A male snap member 50 is affixed onto each of the inverted L-shaped walls 40. After the remote control unit 12 is inserted and the tailgate 42 lifted up, the flexible straps 46 can be bent over to allow the female snap members 48 to engage with the male snap members 50 to prevent the accidental removal of the remote control unit 12 therefrom.

One female snap member 48 and one mating male snap member 50 in combination is the on/off switch 22. The on/off switch 22 can only be manually turned on when the tailgate 42 is lifted up and the female snap members 48 are in engagement with the male snap members 50.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An illumination device for a remote control unit having a plurality of keys which comprises:

a) a housing sized to receive a portion of the remote control unit inserted therein;

b) a lamp located on said housing and positioned to shine a light upon the keys of the remote control unit;

c) a battery located within said housing and electrically connected to said lamp for supplying power to said lamp;

d) an on/off switch located on said housing and electrically connected between said lamp and said battery; and e) a normally opened push button switch located within said housing and electrically connected between said battery and said on/off switch, so that when the remote control unit is inserted into said housing it will close said push button switch, thereby said on/off switch can be manually turned on to energize said lamp and shine the light upon the keys of the remote control unit allowing a person to operate the keys in a dark environment.

2. An illumination device as recited in claim 1, further including:

a) a coiled cord affixed at a first end to said housing; and b) a rubber tipped wand affixed to a second end of said coiled cord, so that said rubber tipped wand can be used in depressing the keys of the remote control unit.

3. An illumination device as recited in claim 1, further including:

a) an elongated platform extending from a lower portion of said housing and sized to fit under a lower surface of the remote control unit; and b) at least one fastening member on said elongated platform for retaining the lower surface of the remote control unit to said elongated platform.

4. An illumination device as recited in claim 1, wherein said housing further includes:

a) an elongated platform extending from a lower portion of said housing;

b) a pair of inverted L-shaped walls, each extending upwardly from one side of said elongated platform to receive the remote control unit when inserted therein;

c) a tailgate hinged at its bottom edge to the rear edge of said elongated platform;

d) a pair of flexible straps, each mounted to an upper corner of said tailgate;

e) a pair of female snap members, each affixed to one distal end of one of said flexible straps; and f) a pair of male snap members, each affixed onto one of said inverted L-shaped walls, so that after the remote control unit is inserted and said tailgate lifted up, the flexible straps can be bent over to allow said female snap members to engage with said male snap members to prevent the accidental removal of the remote control unit therefrom.

5. An illumination device as recited in claim 4, wherein one said female snap member and one said mating male snap member in combination is said on/off switch, whereby said on/off switch can only be manually turned on when said tailgate is lifted up and said female snap members are in engagement with said male snap members.

* * * * *